US010047574B2

(12) United States Patent
Jenner

(10) Patent No.: US 10,047,574 B2
(45) Date of Patent: Aug. 14, 2018

(54) CENTRALIZER AND ASSOCIATED DEVICES

(71) Applicant: CENTEK LIMITED, Newton Abbot, Devon (GB)

(72) Inventor: Andrew Jenner, Vechta (DE)

(73) Assignee: Centek Limited, Newton Abbot, Devon (GB)

( * ) Notice: Subject to any disclaimer, the term of this patent is extended or adjusted under 35 U.S.C. 154(b) by 327 days.

(21) Appl. No.: 14/836,251

(22) Filed: Aug. 26, 2015

(65) Prior Publication Data

US 2016/0060974 A1 Mar. 3, 2016

Related U.S. Application Data

(60) Provisional application No. 62/043,550, filed on Aug. 29, 2014.

(51) Int. Cl.
*E21B 17/10* (2006.01)

(52) U.S. Cl.
CPC ..... *E21B 17/1028* (2013.01); *E21B 17/10* (2013.01); *E21B 17/1078* (2013.01)

(58) Field of Classification Search
CPC ... E21B 17/10; E21B 17/1078; E21B 17/1028
See application file for complete search history.

(56) References Cited

U.S. PATENT DOCUMENTS 2,998,848 A 9/1961 Wright et al.
3,062,297 A 11/1962 Tyrrell, Jr.
3,124,196 A 3/1964 Solum
3,343,608 A * 9/1967 Solum ..... E12B 17/1028 166/172
3,556,042 A * 1/1971 Laughlin ..... E21B 17/1028 166/241.7
4,363,360 A 12/1982 Richey
4,875,524 A * 10/1989 Bradley ..... E21B 17/1028 166/241.6
6,997,254 B2 2/2006 Jenner
2001/0037882 A1* 11/2001 Linaker ..... E21B 17/1028 166/241.1

(Continued)

OTHER PUBLICATIONS

Combined Search and Examination Report for United Kingdom Patent Application GB14153521; dated Sep. 23, 2015; 6 pages.

(Continued)

*Primary Examiner* — Yong-Suk Ro

(57) ABSTRACT

A centralizer, a device and a system. An example centralizer includes: a longitudinal axis, and first and second opposing end collars positioned around the axis of the centralizer; and a plurality of spring bows extending from the first end collar via a generally convex curved portion to the second end collar. A radial distance from an outwardly facing portion of the first end collar to the axis is: greater than a radial distance from a first outwardly facing portion of a spring bow of the plurality of spring bows, at a longitudinal axial position where the spring bow extends from the first end collar, to the axis; and less than a radial distance from a second outwardly facing portion of the spring bow, at a longitudinal axial position between the first end collar and the second end collar that is farthest from the axis, to the axis.

17 Claims, 6 Drawing Sheets

(56) References Cited

U.S. PATENT DOCUMENTS

| | | | |
|---|---|---|---|
| 2004/0112592 | A1 | 6/2004 | Gremillion |
| 2013/0248206 | A1 | 9/2013 | Jordan et al. |

OTHER PUBLICATIONS

Examination Report for European Patent Application EP15275194.7-1614; dated Aug. 25, 2017; 4 pages.
International Search Report and Written Opinion for International application PCT/GB2015/052481; dated Nov. 26, 2015; 10 pages.

* cited by examiner

CENTRALIZER AND ASSOCIATED DEVICES

FIELD OF THE INVENTION

The present invention relates to the field of downhole devices, and more specifically but not exclusively to the field of such devices usable in oil and/or gas extraction. Some arrangements disclosed herein relate to centralizer devices. Some arrangements disclosed herein relate to devices that are connectable to centralizer devices.

BACKGROUND TO THE INVENTION

As known to those skilled in the art, centralizers are used in the oil, gas or water well drilling industries to centre a tubular member (hereinafter referred to as "tubular") within a borehole or previously installed larger tubular.

Such tubulars are generally constructed in handleable lengths, e.g. 12 m (40 ft), each length typically being externally male threaded at both ends. The lengths are assembled together using short female threaded couplings. The assembly of the tubulars to a predetermined total length is referred to as a 'string'.

When the string is disposed in a borehole or existing tubular, it is desirable to position the string substantially centrally within the borehole or existing tubular thereby forming a substantially annular passageway around the tubular of concern. This enables passage of material such as fluids, cement slurries in the space around the tubular.

To try to achieve this condition, centralizers are disposed at selected intervals along the length of the string. Retention of the centralizers in a desired position may be achieved in restricting axial movement by the use of a so-called "stop collar" being a ring grippingly secured to the tubular. The stop collar design must cope with free fitment onto tubulars having poorly toleranced outer diameters. Any design applied must take up this tolerance as pre-requisite to applying sufficient load to give the desired axial load restraint. To resist axial loading, the stop collar may have, for example, toughened steel screws radially dispersed around the circumference of the stop collar that protrude substantially above the outer surface of the stop collar body.

Known spring centralizers have a flexible external diameter aimed at making contact with the bore wall at all times while being capable of flexing to react (restoring force), the lateral forces created by the tubular conforming to the wellbore profile and accommodate obstructions or internal dimensional changes. Such centralizers are comprised of circular end bands between which are affixed a number of leaf springs commonly referred to as 'bows'.

It is desired within the industry that the centrality of the tubular as it is being moved down the borehole to its required final depth position is sufficient to keep the tubular from contacting the borehole or tubular bore such that undue mechanical interference and damage is avoided, be it from the centralizer, stop collar protrusions or couplings.

Contact forces, e.g. stop collar screws, can cause considerable damage to the previously installed steel tubular and generated swarf may cause damage elsewhere in the overall well construction. Too much deflection of centralizer bows will permit contact of, e.g. stop collar screws, which are affixed to the rotating tubular, cutting into the wellbore or larger tubular to which the centralizer is being inserted.

Commonly, especially in well remedial work, the previously installed tubular may have what is referred to as a 'Window' cut through the side of the tubular to permit the centralized tubular being run to deflect through the window.

It follows that, for example, hardened stop collar protrusions and couplings could hold fast against a window edge if lateral forces of deflected centralizer bows are equal to or below the annular height of the protrusions. Hence, in such arrangement it can be quite problematic to move centralizer through the bore hole and into position.

It is furthermore imperative to facilitate the common practice of rotating the tubular as it passes through to its final depth thereby easing passage through high Dog Leg Severity (DLS) undulations. Centralizer rotation is stopped against the bore through which it is being run permitting rotation of the tubular inside the affixed centralizers.

Evolution of wellbore profile complexity has exacerbated occurrence of such mechanical interference. Undulations of the profile defined as a rate of 3 dimensional change referred to as DLS (Dog Leg Severity) per unit length of bore, commonly 30 m (100 ft) frequently result in high lateral forces, perpendicular to the tubular axis. These lateral forces can be such that centralizer spring bows may become flattened or near flattened at various points of high DLS during passage of the centralizer down a wellbore. This can result in, for example, couplings and stop collar protrusions, such as hardened set screws running against the previously installed tubular bore or wellbore. In other words mechanical interference between these parts of the tubular and the previously installed tubular bore or wellbore can occur, leading to surface damage to the previously installed tubular bore or wellbore.

It is additionally noted that said flattening of bows may result in permanent deformation of the bows, especially at the point of spring rotation at the meeting point of leaf, or bow, spring to end band. This can result in the original centralization potential of the centralizer becoming adversely affected when a desired depth is reached. It is preferred within the industry that centrality between tubulars or tubular and the wellbore, when centralized tubular is at its required depth, is maximised or to a minimum acceptable level. In other words, the tubular is located centrally within the previously installed tubular or wellbore, or the distance between the tubular and previously installed tubular or wellbore is maintained above a minimum distance.

FIG. 1 illustrates a known tubular arrangement that has been inserted within a borehole 50. A centralizer 38 is located on the tubular by way of stop collars 37 located either side of the centralizer 38. Stop collars 37 are used to mount around the tubular to engage and grip the exterior of the tubular. The stop collars 37 provide a stop shoulder on the tubular to restrict axial travel along the tubular member of any further associated product such as a centralizer 38. Each centralizer 38 is therefore joined to the tubular and arranged to support the tubular within the borehole 50 such that the tubular is substantially centrally arranged within the borehole 50.

The one-piece centralizer 38 has first and second opposing end collars 41, 42 that are axially separated by plural spring bows. Only spring bows 43, 44, 45, and 46 of the plural spring bows are shown.

Each spring bow forms a generally convex curve. This is clearly observed for spring bows 45 and 46. However, the effect of high lateral forces from the tubular has caused deflection of the centralizer spring bows. This has caused the flattening of spring bow 43. The lateral forces have caused sufficient deflection for some of the set screws 47 of the stop collar 37 to be pushed hard against the borehole 50.

This situation can be problematic. This is because the tubular is now contacting the borehole 50, which can lead to mechanical interference and damage. Furthermore, contact forces from, for example, the contact screws 47, can cause damage to the borehole 50. Too much deflection of the centralizer spring bows will enable, for example, stop collar screws 47 to cut into the well bore 50. Considerable damage to the borehole 50 can occur. This damage can also generate swarf that can cause damage elsewhere. Due to flattening of the spring bow 43, parts of the tubular, for example the stop collar screws 47 of stop collar 37 that is grippingly attached to the tubular, can hold fast to the borehole 50 because the stop collar 37 is pushed against the borehole 50. This can constrain the tubular from rotating. This situation also applies for a tubular inserted within a previously installed tubular rather than within a borehole 50.

Additionally, spring bow 43 has been flattened to an extent that can cause permanent or irreversible deformation. Spring bow 43, and any other spring bow that has similarly been flattened, will not now spring back to its original shape or not spring back sufficiently to provide the required centring or restraining effect. This means that centralizer 38 cannot now centralize the tubular optimally. This can occur, for example, when the tubular is further passing through the borehole 50 or tubular bore 40. When there are high lateral forces, because the spring bow 43 is now flattened, the centralizer 38 will be offset, or can be more easily offset, and it becomes more likely that mechanical interference between the tubular and the bore hole 50 or tubular bore 40 will result. This is because, since spring bow 43 has become flattened, the centralizer 38 cannot perform its function correctly and centre the tubular within the borehole 50 or tubular bore 40. Therefore, even lateral forces less than that that were required to flatten spring bow 43 can now push the tubular hard against the borehole 50 or tubular bore because spring bow 43 is flattened and cannot resist lateral forces. This pushing of the tubular against the borehole 50 or tubular bore 40 can cause damage as already discussed. Also, when the tubular reaches its final depth, centralizer 38 can be located at a position where the borehole 50 has a wider diameter than that typical for other parts of the borehole 50. Such a scenario is with so-called "under reamed" bores, occurring where wellbores are 'opened out' in a region lower than a previously installed tubular. In such a circumstance, because spring bow 43, and indeed other spring bows, of the centralizer 38 has or have been flattened, leading to permanent deformation or otherwise to the spring bows not functioning optimally, the centralizer 38 cannot mechanically secure the tubular in position at that location. This is because the flattened spring bow 43, and indeed other flattened spring bows, will not spring back to their original shape, or will not spring back sufficiently to make the required contact with the wall of the borehole 50 or tubular bore 40. Therefore, the centralizer will not make the required robust mechanical connection with the borehole 50 at that location, and the tubular will neither be centrally located, nor mechanical constrained to the required degree, within the borehole 50 or tubular bore 40.

A problem with existing centralizers that are installed on a tubular inserted within a borehole or previously installed tubular, is that damage can occur to the wall of the borehole or previously installed tubular. This damage is due to mechanical interference occurring between, for example the screws on stop collars, and the wall of the borehole or previously installed tubular, which is further exacerbated by the flattening of the spring bows.

SUMMARY

Disclosed herein is a spring centralizer arranged to control and limit the degree of spring deflection.

A controlled deflection of a spring centralizer device to a desired minimum annular width between the tubular upon which the centralizer is mounted and the borehole or bore of a previously installed tubular member is disclosed.

There is provided an improvement to a spring centralizer device in supporting a tubular member to a predefined minimum distance from the wall of a bore.

The spring centralizer is a device for supporting a tubular member spaced from the wall of a bore. The spring centralizer device may have a longitudinal axis, and the spring centralizer device may comprise first and second mutually spaced collar portions and may have a plurality of bow leaf spring portions disposed between. Each collar portion may be substantially cylindrical. The centralizer device may extend substantially around or all around said longitudinal axis. Method of construction may consist of, but not be limited to, mechanically interlocking parts, welded assembly of parts or construction from a single piece material.

Each collar portion may have radially disposed parallel to axis protrusions projecting above the external diameter of the collar portion. Protrusions may be formed from the collar portion material or as securely attached added parts.

Protrusions may be angled and/or shaped to direct fluids into turbulent flow within the annulus to aid suspension and removal of detritus. The angled and/or shaped protrusion interrupts laminar flow passing the centralizer, thereby creating a turbulent flow which aids cleaning of the wellbore of detritus and/or removal of such fluids when displacing with cement into the annulus between the tubular and the borehole or existing tubular.

Protrusions may be applied to a single collar portion only.

Protrusions may be applied or may be formed on a band that is separate to the collar portions of a centralizer. The band may be arranged to butt up against, or be secured or otherwise coupled to the centralizer. The band is not grippingly attached to the tubular such that the band can freely rotate about the tubular. In other words, the band may be freely rotatable about the tubular. The band can rotate about the tubular in the same manner that the centralizer does. The protrusions may be formed on a collar that sits between the centralizer and a stop collar that is used to support a centralizer. The collar may then be "free floating" between an end of the centralizer and a contacting edge of the stop collar. The protrusions may be formed on a band that is located around a tubular, such that it prevents a stop collar or other such device from mechanically interfering with the wall of a borehole or previously installed tubular, without the requirement that the band operate in co-operation with a centralizer.

The device may consist of protrusions of various designs formed radially outward on centralizer end collars such that it is not possible to completely flatten the spring bows. The protrusions may be formed from or may be attached to the end collars such that they have an axis normal to the surface of the end collars that is angled to a radius of the centralizer. Spring bow performance integrity may be maximised with removal of permanent deformation from extreme flattening at point of rotation of spring bow to end collar. The device may consist of protrusions of various designs such that spring bow performance integrity may be maximised with removal of permanent deformation from extreme flattening at point of rotation of spring bow to end collar.

Protrusions may be made to ensure contact with associated mechanisms, affixed to the tubular on one or either side of the centralizer, will not come in contact with the borehole or previously installed tubular bore. Drag resistance running to depth may be reduced by removing mechanical interference of associated mechanisms with the borehole or previously installed tubular bore resulting in passage resistance forces only attributable to the lateral force of the tubular being run conforming to the wellbore profile multiplied by the customer dictated Coefficient of friction (CoF). The CoF multiplied by the lateral force is referred to as 'Drag'. If the total Drag of all parts of the tubular is too large, the tubular will be prevented from being pushed further into the borehole or existing tubular. Consequently, the tubular will not be able to reach the final desired depth.

Contact of, for example stop collar screws, may be eliminated through provision of the protrusions, ensuring rotation of the centralized tubular may only be inside the centralizer end bands. Height and form of protrusions may permit ease of guidance through apertures in a previously installed tubular. Protrusions may further be tailored to stop deflection of spring bows such that a height (standoff), within the annulus between tubular and borehole may be achieved as a minimum. For example, the standoff may be in accordance with the dictates of API 10D at 67% standoff or whatever standoff % the end user application may tolerate or demand.

According to an aspect, there is provided a centralizer having a longitudinal axis, the centralizer comprising: first and second opposing end collars positioned around the axis of the centralizer; and a plurality of spring bows extending from the first end collar via a generally convex curved portion to the second end collar. A radial distance from an outwardly facing portion of the first end collar to the axis is greater than a radial distance from a first outwardly facing portion of a spring bow of the plurality of spring bows, at a longitudinal axial position where the spring bow extends from the first end collar, to the axis. A radial distance from an outwardly facing portion of the first end collar to the axis is less than a radial distance from a second outwardly facing portion of the spring bow, at a longitudinal axial position between the first end collar and the second end collar that is farthest from the axis, to the axis.

The radial distance from the outwardly facing portion of the first end collar to the axis may be greater than the radial distance from a third outwardly facing portion of the spring bow, at a longitudinal axial position where the spring bow extends from the second end collar, to the axis.

The outwardly facing portion of the first end collar may comprise at least a portion of a protrusion. The protrusion may be formed from the first end collar. The protrusion may be attached to the first end collar. The protrusion may be in the form of a bow. The bow may comprise a generally convex curved portion. The protrusion or protrusions may be substantially semi-spherical or hemispherical. The protrusion may be formed through a process or processes involving a pressing process. The protrusion may be formed through a process or processes involving a bending process. The protrusion may be further formed through a process or processes involving a cutting process. The protrusion may have a length and a width less than the length, and the length may be angled to the longitudinal axis of the centralizer. The protrusion may be a first protrusion of a plurality of protrusions. The plurality of protrusions may be uniformly distributed about a perimeter of the first end collar.

The outwardly facing portion of the first end collar may have a shape configured to direct fluid flow into a turbulent flow.

The centralizer may be made from a single piece material. The centralizer may be made from mechanically interlocking parts. The centralizer may be made from parts welded together.

The centralizer may be configured to support a tubular member to a predefined distance from a wall of a bore. The centralizer may be configured to accord with the dictate of API 10D at 67% standoff.

According to another aspect, there is provided a device having a longitudinal axis, the device configured to cooperate with a centralizer. The centraliser has a longitudinal axis and comprises first and second opposing end collars positioned around the axis of the centralizer, and a plurality of spring bows extending from the first end collar via a generally convex curved portion to the second end collar. The device comprises an outwardly facing portion. When the axis of the device and the axis of the centralizer are substantially aligned co-axially a radial distance from the outwardly facing portion of the device to the axis is greater than a radial distance from a first outwardly facing portion of a spring bow of the plurality of spring bows, at a longitudinal axial position where the spring bow extends from the first end collar, to the axis. When the axis of the device and the axis of the centralizer are substantially aligned co-axially a radial distance from the outwardly facing portion of the device to the axis is less than a radial distance from a second outwardly facing portion of the spring bow, at a longitudinal axial position between the first end collar and the second end collar, to the axis.

The radial distance from the outwardly facing portion of the device to the axis may be greater than the radial distance from a third outwardly facing portion of the spring bow, at a longitudinal axial position where the spring bow extends from the second end collar, to the axis.

The outwardly facing surface of the device may comprise at least a portion of a protrusion. The protrusion may be formed from the device. The protrusion may be attached to the device. The protrusion may be in the form of a bow. The bow may comprise a generally convex curved portion. The protrusion or protrusions may be substantially semi-spherical or hemispherical. The protrusion may have a length and a width less than the length, wherein the length may be angled to the longitudinal axis of the device. The protrusion may have a shape configured to direct fluid flow into a turbulent flow. The protrusion may be a first protrusion of a plurality of protrusions. The plurality of protrusions may be uniformly distributed about a perimeter of the device.

The outwardly facing surface of the device may have a shape configured to direct fluid flow into a turbulent flow.

The device may be made from a single piece material. The device may be made from mechanically interlocking parts. The device may be made from parts welded together. The device may have one or more connecting portions for connecting to a centralizer.

The device may be configured to freely rotate about a tubular.

The device, in cooperation with the centralizer, may be configured to support a tubular member to a predefined distance from a wall of a bore. The device, in cooperation with the centralizer, may be configured to accord with the dictate of API 10D at 67% standoff.

The device may have T-shaped projections arranged to extend into corresponding female T-shaped apertures of the centralizer, for connecting the device to the centralizer. The centralizer may have T-shaped projections arranged to extend into corresponding female T-shaped apertures of the device, for connecting the device to the centralizer. The device may have bayonet fastenings arranged to engage with an end collar of the centralizer, for connecting the device to the centralizer. The end collar of the centralizer may have bayonet fastenings arranged to engage with the device, for connecting the device to the centralizer.

The device may be a band. The device may be a collar.

In another aspect, there is provided a system comprising a device, the device being as described above or anywhere herein. The system may also comprise a centraliser. The centraliser may have a longitudinal axis. The centralizer may comprise first and second opposing end collars positioned around the axis of the centralizer, and a plurality of spring bows extending from the first end collar via a generally convex curved portion to the second end collar.

The micro-alloy steel that may be used for the centralizer, protrusion, protrusions and/or band may be Boron steel. This is one example of the material that can be used for the centralizer, or protrusions and other suitable materials can be used. The material that may be used for the centralizer, protrusion, protrusions and/or band may be heat treatable to improve, for example, shear and tensile section strength properties. Such heat-treated strength may be of the order 90 tons per square inch.

BRIEF DESCRIPTION OF THE DRAWINGS

Specific arrangements of the disclosure shall now be described below by way of example only and with reference to the accompanying drawings in which.

SPECIFIC DESCRIPTION

Figure 2:
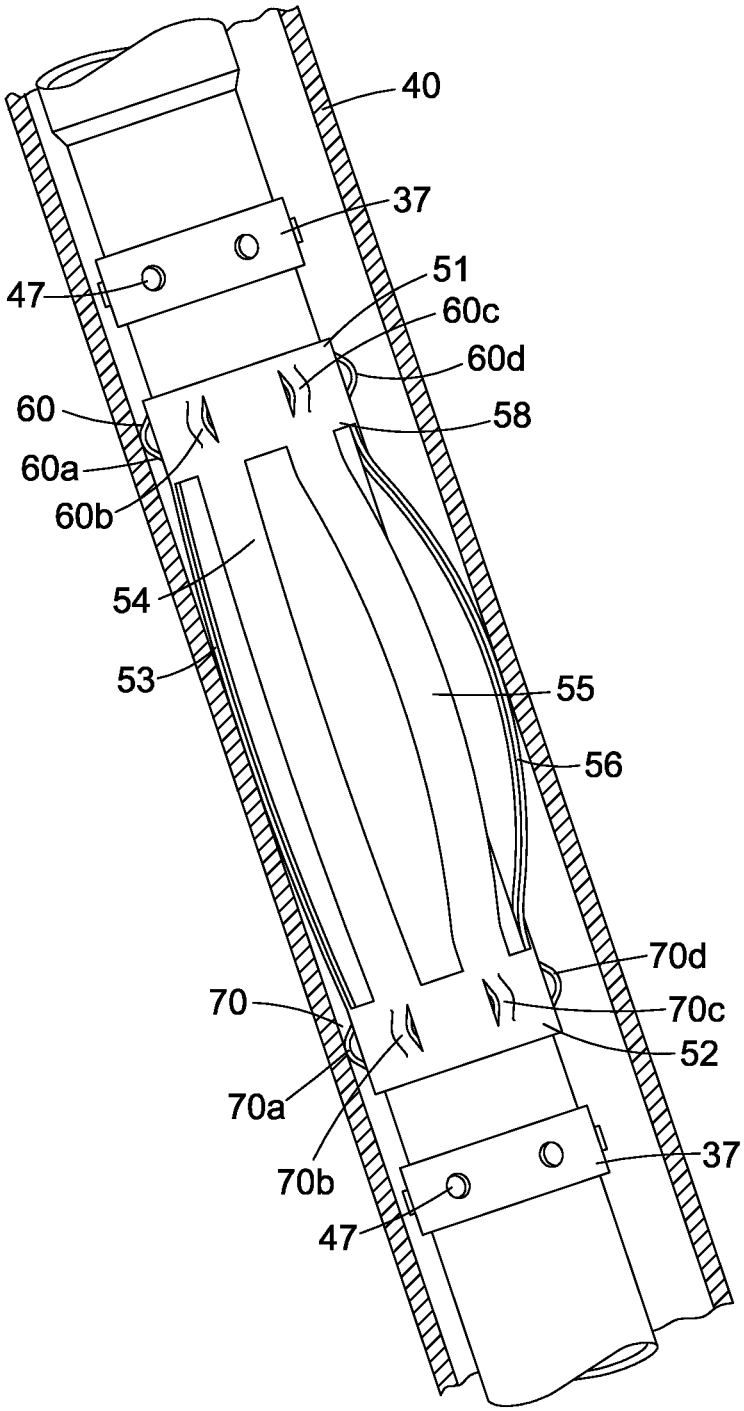
FIG. 2 shows a centralizer within an existing tubular bore.

FIG. 2 provides an exemplary centralizer arrangement in which a plurality of protrusions 60, 70 are provided on end collars 51, 52 of the centralizer 58 in order to prevent flattening of the centralizer's spring bows 53, 54, 55, 56 and prevent the screws 47 of the stop collar 37 causing damage to the bore 40. The arrangement of FIG. 2 shall now be discussed in detail.

Figure 1:
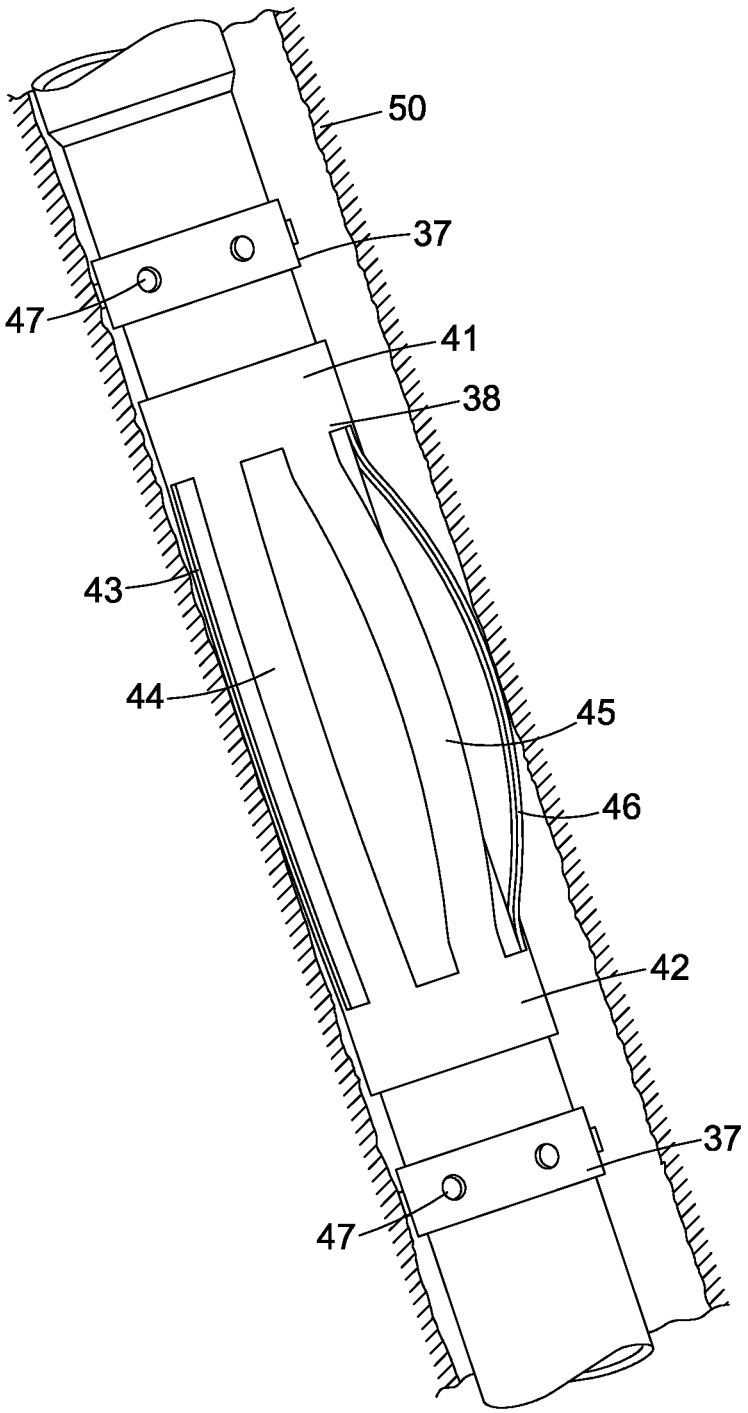
FIG. 1 shows a known arrangement of a tubular received within a borehole, and shows the effect of high lateral forces from the tubular, within the borehole, thereby causing deflection of the centralizer spring bows.

Referring to FIG. 2, a tubular similar to that shown in FIG. 1 has been inserted within an existing tubular bore 40. A centralizer 58 is located on the tubular. In FIG. 2, a situation similar to that presented in FIG. 1 is shown. However, FIG. 2 shows the effect of radially disposed protrusions beyond the external diameter of the centralizer collar portions limiting deflection of the spring bows thereby keeping, for example, typical stop collar set screws clear of the previously installed tubular internal diameter.

The one-piece centralizer 38 has first and second opposing end collars 51, 52 that are axially separated by 6 spring bows, of which only 4 are shown 53, 54, 55, 56. Each spring bow forming a generally convex curve. The plurality of spring bows extend from the first end collar 51 to the second end collar 52.

The first end collar 51 has six protrusions 60 around the circumference of the collar, of which only the four protrusions 60*a*, 60*b*, 60*c*, and 60*d* are shown. The second end collar has six protrusions 70 around the circumference of the collar, of which only the four protrusions 70*a*, 70*b*, 70*c*, and 70*d* are shown.

The protrusions 60, 70 protrude from the first and second end collars 51, 52 and come into contact with the wall of the existing tubular 40 due to high lateral forces offsetting the tubular within the existing tubular 40. The protrusions 60, 70 protrude to a height above the surface of the first and second end collars 51, 52, such that the stop collars 37 are kept clear from the wall of the existing tubular 40. This means that stop collar screws 47 are kept away from the wall of the existing tubular 40. Other mechanisms that can be affixed either side of the centralizer are also kept from contacting the wall of the tubular 40.

Additionally, the protrusions 60, 70 protrude to a height from the surface of the first and second end collars 51, 52, such that the plurality of spring bows do not become completely flattened as the centralizer is pushed up against the wall of the existing tubular 40. The spring bows may not become completely flattened, however the protrusions still stop the spring bows from becoming deformed to an extent that leads to permanent deformation or deformed to an extent that leads to the spring bows not being able to perform optimally. As seen in FIG. 2, spring bow 53 has deformed but has not become completely flattened. The height of the protrusions above the surface of the first and second end collars 51, 52 is provided such that the spring bows can deform, but can then spring back as required. For example, as the centralizer moves to a more central position within the tubular or indeed as the centralizer moves toward the opposite side of the tubular, bow spring 53 can take the form of bow spring 56, as shown in FIG. 2, and bow spring 56 can take the form of bow spring 53. This means that the spring bows have not suffered permanent deformation, or have not suffered plastic deformation. In other words the spring bows can continue to operate as intended.

Figure 3:
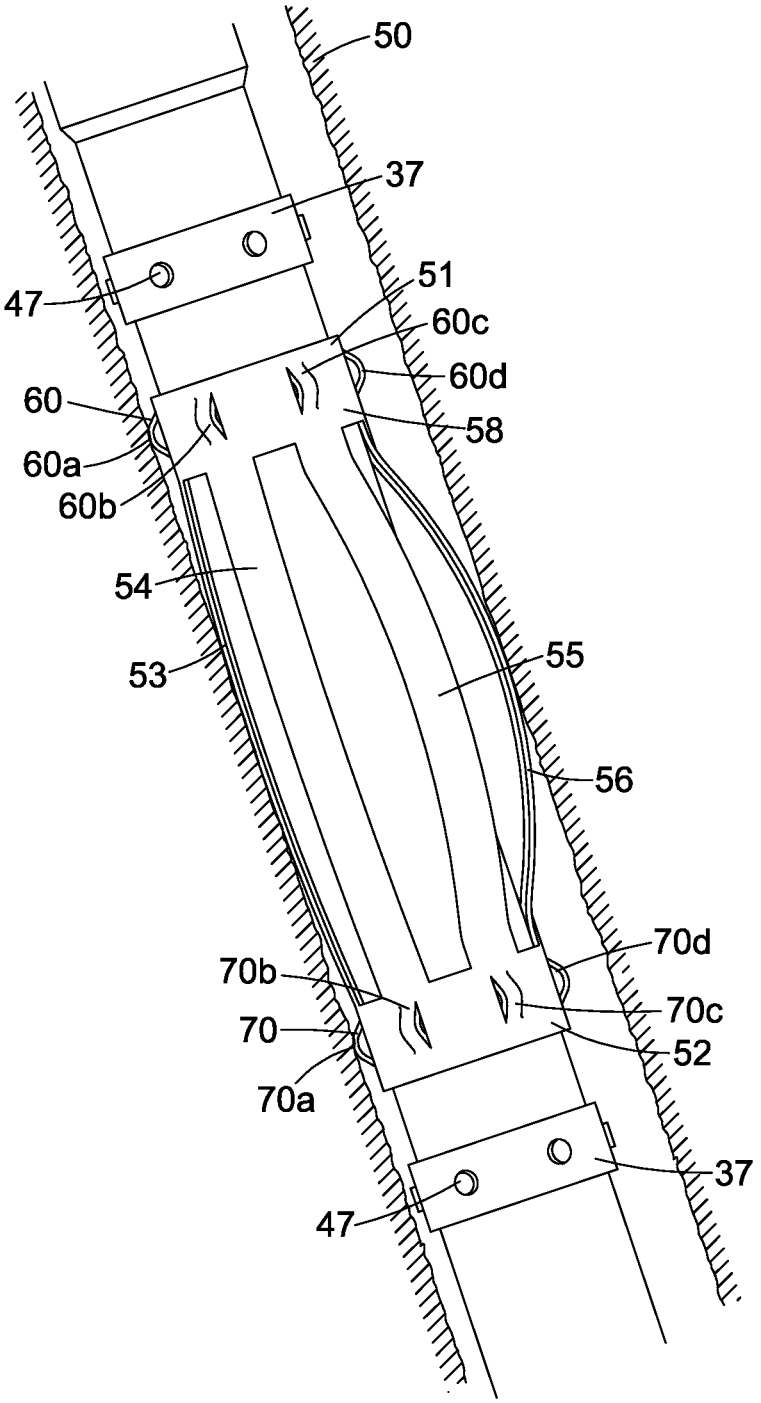
FIG. 3 shows a centralizer within a borehole.

In FIG. 3, a similar situation to that shown in, and described with reference to FIG. 2, is shown. However, in FIG. 3 the centralizer 58 is inserted within a borehole 50.

Contact between the tubular and the wall of the borehole 50 or existing tubular is via the spring bows of the centralizer and via the spring bows and protrusions at particular sections of the borehole 50 or existing tubular. The protrusions are appropriately shaped and formed to have a reduced mechanical interference with the wall of the borehole 50 or existing tubular. This means that the protrusions, when contacting the wall of the borehole or existing tubular, do not damage the wall of the borehole or tubular. Therefore, the protrusions stop the tubular parts such as stop collars other than the centralizer from contacting the wall of the borehole 50 or existing tubular which leads to a reduced mechanical interference with the wall of the borehole 50 or existing tubular. Damage to the borehole 50 or existing tubular 40 is reduced. Drag resistance running to depth is reduced by removing mechanical interference of associated mechanisms with the borehole 50 or previously installed tubular bore 40. This results in passage resistance forces only attributable to the lateral force of the tubular being run conforming to the wellbore profile x the customer dictated CoF (Coefficient of friction).

Figure 4:
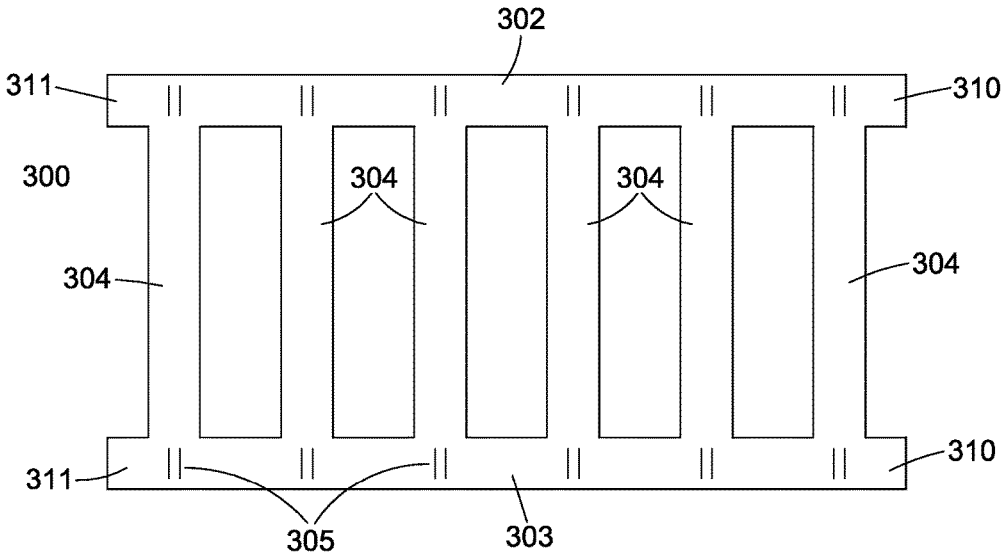
FIG. 4 shows an exemplary blank used in forming the centralizer of FIGS. 2 and 3.

The manufacture of the centralizer 58 shown in FIGS. 2 and 3 shall now be described with reference to FIG. 4. The centralizer of the described arrangement has spring bows of equal length, and this means it can be made from a single blank, an example of which is shown in FIG. 4. Referring to FIG. 4, a blank 300, is formed from a single sheet of boron steel. The blank has two transverse web portions 302, 303 spaced apart by six spaced longitudinal web portions 304 which extend substantially parallel to one another and perpendicular to the webs 302, 303. The first and second transverse web portions 302, 303 are generally rectangular in shape, and are mutually parallel. The six longitudinal web portions 304 extend between the transverse web portions 302,303 to define therebetween five apertures 309 of equal size. The outer longitudinal web portions 304 are inset from the ends of the transverse web portions by around half the width of the apertures 309 to leave free end portions 310,311 of the transverse web portions.

The free end portions are overlappingly secured together so that each first end portion 310 overlaps its corresponding second end portion 311 whereby the centralizer forms a generally cylindrical device. In other arrangements, the length of the free end portions is greater, and in these arrangements the free end portions are subsequently formed into connecting devices.

Figure 5:
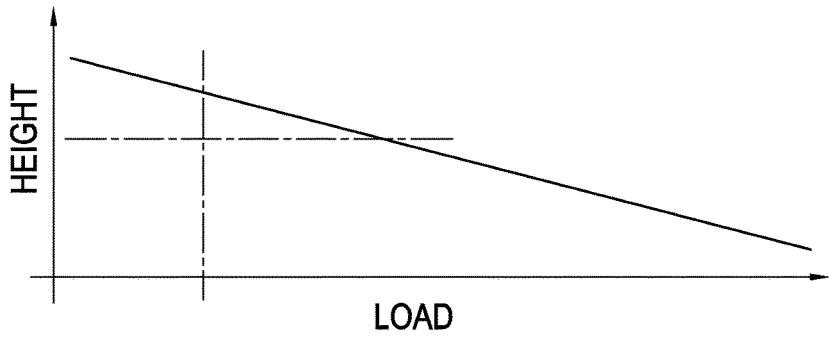
FIG. 5 shows a standoff within the annulus between a tubular and a borehole as a function of load, as required by specification API 10D based upon common size 9⅝" casing inside 12¼" borehole.

The web portions 302, 303 form the collars 51, 52 of FIGS. 4 and 5. The longitudinal web portions 304 form the spring bows of FIGS. 4 and 5, of which four are shown as spring bows 53, 54, 55, and 56. Bending operations are performed on the spring bows to achieve the configuration of FIGS. 4 and 5.

The web portions 302 and 303 have a series of parallel cuts 305 that cut all the way through the blank. Web portions 302 and 303 each have six sets of two parallel cuts 305 that are centrally aligned with the longitudinal web portions 304 and are parallel to the web portions 304. The series of parallel cuts 305 in the web portion 302 enable the blank material between the cuts 305 to be formed into protrusions 60, 70 in the first and second end collars 51, 52. The material between the series of cuts 305 is bent to form protrusions 60 and 70, in the form of convex bows that sit proud of the surface of the blank. The protrusions 60, 70, in the form of bows are aligned in the same direction as the spring bows. The protrusions 60, 70 have a longitudinal axis that is parallel to the longitudinal axis of the centralizer. The protrusions 60, 70 are uniformly distributed about the perimeter of the first and second end collars 51, 52. In other arrangements, protrusions 60, 70 take a form different to that of convex bows.

It will, of course, be understood that this is a purely exemplary blank and is used here illustratively. Boron steel is only one example of the materials that may be used, which include mild steel and many other different materials. One class of steel—which includes boron steel—is the class of micro-alloy steels. This class has been shown to be generally useful.

The blank is formed by cutting or punching from the sheet. A preferred technique is a high accuracy computer-controllable cutting method such as laser-cutting or water jet-cutting. Such a technique can allow great flexibility, for instance enabling 'specials' to be produced without a need for expensive dedicated tooling. The blank is then cold-formed into a generally cylindrical shape. This may be accomplished by rolling or by other techniques known in the art.

The relatively ductile nature of the boron steel material forming the blank allows for the blank to remain in its cylindrical state after the forming has taken place. The boron steel, or other material used for the blank, is heat treatable to improve, for example, shear and tensile section strength properties. Such heat-treated strength may be of the order 90 tons per square inch.

In other arrangements, the protrusions are formed in, or attached to, the end collars of an existing centralizer rather than being formed in a blank that is then formed into a centralizer. In one arrangement a series of parallel cuts, similar to those shown as 305 in FIG. 4, are cut into the end collars of the existing centralizer, and the material between the cuts is bent or pressed into the required protrusion shape, such as a convex bow. In another arrangement, protrusions are securely attached to the end collars of the existing centralizer. The protrusions could be welded, or through being mechanically attached to the end collars.

FIG. 5 shows the standoff within the annulus between a tubular and a borehole as a function of load, as required by specification API 10D based upon a common sized 9⅝" (24.45 cm) casing inside a 12¼" (31.12 cm) borehole. It can be seen that the curve extends to near flat, with a resultant increase of load.

A centralizer must achieve minimum 1600 lbf (7120N) restoring force when deflected to 67% 'standoff' of the theoretical 100% annular width. In this instance this corresponds to a height of 0.879" above zero on the 'Y' axis. This actual example exceeds the requirement, having a restoring force of 3250 lbf (14460N).

Figure 6:
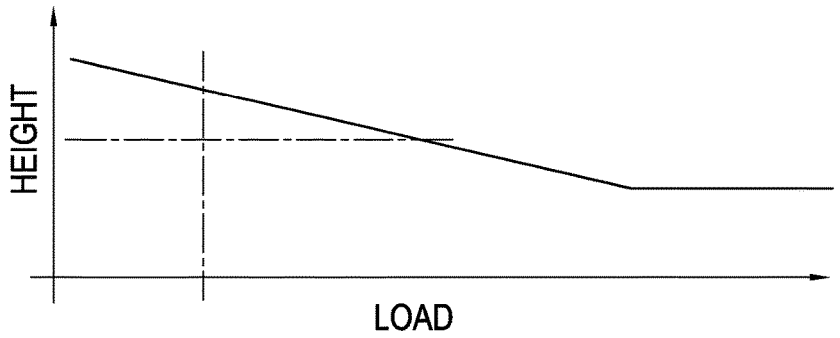
FIG. 6 shows a standoff within the annulus between a tubular and a borehole as a function of load for the centralizer as shown in FIGS. 2 and 3.

FIG. 6 shows a standoff within the annulus between a tubular and a borehole as a function of load, for the centralizer as shown in FIGS. 2 and 3. In FIG. 6 the deflection/load curve exhibits an intersection or kink in the curve. This is due to the radially disposed protrusions around the first and second end collars 51, 52. In this example the protrusions correspond to the basic protrusion minimum height ref. "January 2014 the Railroad Commission of Texas USA formulated amendments to their Rule 13 governing minimum precautions". As may be seen from the point of intersect the curve extends parallel to the 'X' axis (load), i.e. the spring has bottomed onto the protrusions. The spring bows of the centralizer are stopped from completely flattening or suffering deformation that stops them from springing back into shape or otherwise functioning as intended. Additionally, by bottoming out on the protrusions, the tubular is maintained above a minimum distance from the wall of the borehole. This means that that interference between, for example, stop collars and the wall of the borehole is prevented.

Figure 7:
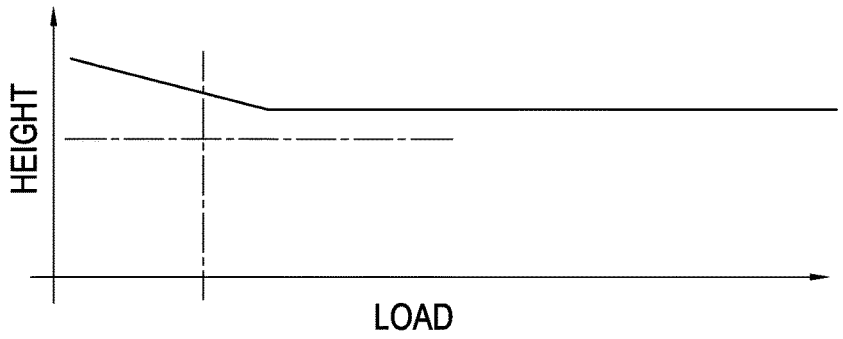
FIG. 7 shows a standoff within the annulus between a tubular and a borehole as a function of load, for a centralizer having protrusions with a height greater than the height of the protrusions for the centralizer of FIGS. 2 and 3.
Figure 8:
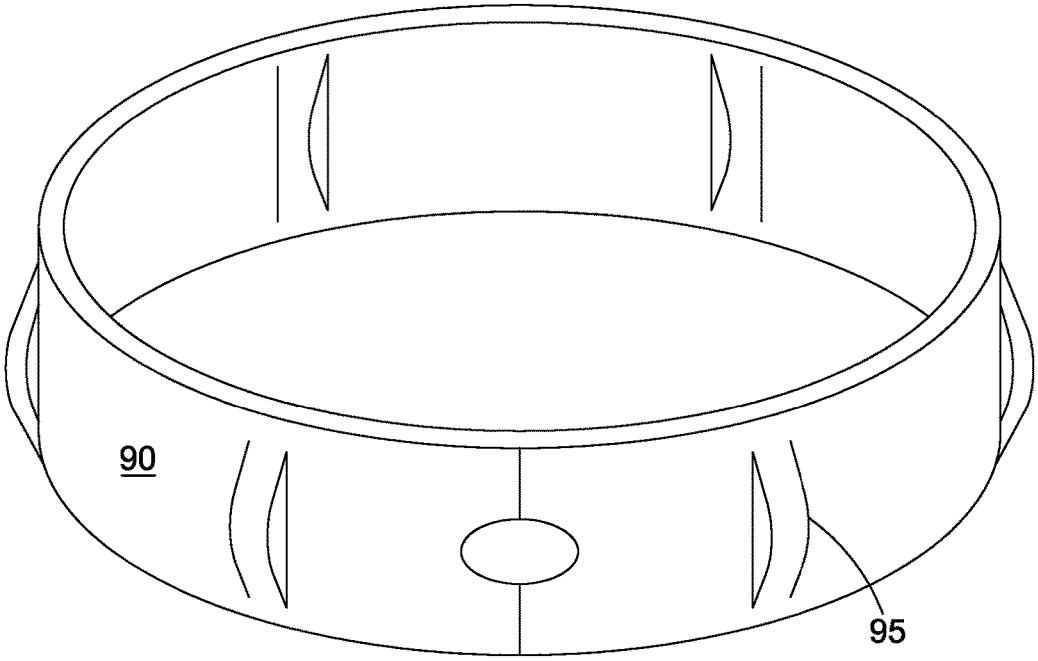
FIG. 8 shows a perspective view of an end collar.

FIG. 7 shows a standoff within the annulus between a tubular and a borehole as a function of load, for a centralizer having protrusions with a height greater than the height of the protrusions for the centralizer used to provide data as shown in FIG. 6. For the centralizer used to provide data as shown in FIG. 8, a tailored height of the protrusion has been determined by an end user. The height of the protrusion in this example is over and above the basic protrusion height (ref. FIG. 6). In this instance the height of the protrusions corresponds to ca 70% Standoff (0.919" (2.33 cm)). In this example the end user benefits from flexibility of a spring design until stopping hard against the 70% required as a minimum Standoff.

Therefore, the design of the protrusions can be tailored for the specific requirements of the centralizer.

In an alternative arrangement, shown in FIG. 8, the protrusions are not radially disposed about the first and second end collars 51, 52 of a centralizer. Rather, the protrusions are radially disposed about one or more bands 90 that are coupled to either the first or both the first and second end collars 51, 52 of the centralizer. The one or more bands 90 are freely rotatable about the tubular, meaning that they are not grippingly attached to the tubular and the tubular can freely rotate within the bands 90. The band 90 is made in a similar manner to the centralizer as discussed with reference to FIG. 4. Band 90 is made from a blank, with cuts formed in the blank that are bent or pressed into protrusions 95.

Using bands with protrusions means that an existing centralizer can be retrofitted by attachment of bands with protrusions to the first and second end collars of a centralizer. The existing centralizer may need to be modified to enable the bands with protrusions to be connected to it, but the work required can be less than that associated with making new centralizers with protrusions on the end collars.

In some arrangements, the bands may be connected to the centralizer. For example, in certain arrangements the bands may be connected to the centralizer through T shaped projections and apertures in the bands and apertures respectively. In other arrangements the bands are connected to the centralizer through a bayonet fastener.

In other arrangements, the bands are located on a tubular and do not mechanically interlock to a centralizer, but are arranged to butt up against a centralizer as the tubular is inserted down a borehole. In this arrangement, the bands are arranged to be free floating between an end of the centralizer and a contacting edge of a stop collar. In other arrangements, the bands are located on a tubular, and are arranged to ensure that stop collars do not mechanically interfere with the wall of the borehole without being required to cooperate with a centralizer.

Alternative arrangements to those described with reference to the figures are now briefly discussed.

In other arrangements the centralizer has more than or less than six spring bows.

In other arrangements the centralizer has more than or less than six protrusions around the circumference of the first and second end collars. In some arrangements, the number of protrusions on the first end collar is different to the number of protrusions on the second end collar. In some arrangements, there are only protrusions on the first end collar. In some arrangements the protrusions are not uniformly distributed about the perimeter of the first and/or second end collars.

In some arrangements there is only one protrusion. For example, in one arrangement a protrusion may completely encircle an end collar. In another arrangement the single protrusion doesn't fully encircle the end collar, but has a gap such that the protrusion forms a horseshoe shape. In yet another arrangement the single protrusion is arranged helically around the end collar. In arrangements such as the horseshoe and helical arrangements, the protrusion has a shape arranged to allow for fluid flow within the annulus between the tubular and the borehole or existing tubular. Furthermore, in other arrangements there may not be a protrusion, as such. Instead, the end collar may be raised relative to the bows, or the bows may join the end collar at a point that is not the maximum radial distance of the end collar from the axis of the centralizer. In other words the whole of end collar is a protrusion. In such an arrangement, the end collar prevents flattening of the spring bows without the need for a specific protrusion.

In some arrangements, the protrusions are not aligned with the spring bows of the centralizer.

In some arrangements, cuts 305 are not parallel. In some arrangements, cuts 305 are not centrally aligned with web portions 304. In some arrangements, cuts 305 are not parallel to web portions 304. In some arrangements, the protrusions are formed from the blank, without the need for cuts 305 in the blank, for example through appropriate pressing or bending of the blank.

In other arrangements, the protrusions are attached to the first and/or second end collars rather than being pressed or punched or bent from the blank.

In some arrangements, the protrusions have a longitudinal axis that is angled to the longitudinal axis of the centralizer. This has the benefit that this creates a shear angle to further aid passage of the centralizer through bore local deformities or obstructions. In one arrangement, substantially all of the protrusions are angled similarly.

In some arrangements, a protrusion has a longitudinal axis that is angled to the longitudinal axis of the centralizer and is angled to the longitudinal axis of another protrusion.

In some arrangements, the protrusions are shaped or angled or angled and shaped in order to direct fluids into a turbulent flow within the annulus between tubular and the borehole or existing tubular. This angling and/or shaping of the protrusions is now further explained. Ideal fluid flow through the annulus between the tubular and borehole or existing tubular is laminar, i.e. uniform, parallel to the axis. The protrusions may be angled and/or shaped to deflect the laminar flow, creating turbulent flow beyond the protrusion in the direction of fluid flow. This has a particular advantage in terms of unwanted contaminants such detritus, which is particulate matter/debris. Wells contain various fluids, e.g. 'Drilling Mud', to balance pressure differentials. Cement flowing into the annulus, from the bottom back towards the surface, is required to displace these fluids. However, where the tubular is offset in the annulus there will be fluid/cement contaminated pockets, for example at the position where the tubular is close to the wall of the borehole and the annulus has a minimum size. Furthermore, there will be preferential flow at the opposite side of the tubular, where the annulus has a maximum size. Where the annulus is a minimum, detritus, debris or fluids can accumulate or build up. The angled and/or shaped protrusions direct the flow into a turbulent flow and this assists in the removal of unwanted debris or fluids.

Angling and/or shaping of the protrusions can have the benefit that it enables the passage of material such as fluids, cement slurries in the annular space around the tubular between the tubular and the borehole or existing tubular. The presence of the protrusions, which have an effect of halting or stopping flattening of spring bows, means that there remains a minimum annular gap between the tubular and bore hole or existing tubular. There then remains a minimum cement sheath thickness, allowing for the required flow of cement in the annulus between the tubular and bore hole or existing tubular.

In some arrangements, angling and/or shaping of the protrusions aids the suspension and removal of detritus within the annulus. The skilled person will appreciate how protrusions can be shaped or angled or shaped and angled in order to change the flow as described above.

In some arrangements, the protrusions are symmetrical. For example, they are substantially semi-spherical or hemispherical in shape and are either attached or pressed from the blank. In some arrangements, the protrusions are symmetrical, but shaped other than semi-spheres or hemispheres.

In another arrangement, the centralizer is not made from a single blank. In some arrangements, protrusions are attached to the band.

In some arrangements, the first end collar is symmetrical about its axis, for example the first end collar may have a cylindrical shape. In some arrangements, the second end collar is symmetrical about its axis, for example has a cylindrical shape. In some arrangements, the band is symmetrical about its axis, for example has a cylindrical shape.

In some arrangements, the first end collar is asymmetrical about its axis, for example has a non-cylindrical shape. In some arrangements, the second end collar is asymmetrical about its axis, for example has a non-cylindrical shape. In some arrangements, the band is asymmetrical about its axis, for example has a non-cylindrical shape. In some arrangements the first end collar, second end collar, and or band has a cross section other than circular. For example, the surfaces of the first end collar, second end collar and/or band arranged to face the tubular have a polygonal cross section that is either regular or irregular. It will be appreciated that the irregular shape of the end collar and/or band may in itself perform the functionality of the protrusions if the irregular shape provides a portion that protrudes such that flattening of the spring bows is prevented. It will also be appreciated that while reference has been made to a 'band', since the shape may be irregular it may not have a band-like shape. As such, the band can more generally be referred to as a device. Furthermore, in some arrangements the band or device may be the end stop.

As described above, centralizers are provided or centralizers can be modified or bands are provided that can be connected to centralizers, or bands are provided that operate without be required to cooperate with centralizers. These arrangements negate, when under extreme lateral forces encountered running the centralizer string into the well, the flattening of the centralizer with potential permanent set of bow spring height and damage to the well bores. These arrangements provide for ease of insertion of the centralizer string into the well. These arrangements provide for ease of insertion of the tubular into the well. These arrangements provide for modification of the flow of fluid past the centralizer, and/or band, and may direct that flow into a turbulent flow. These arrangements provide for modification of the flow that aids the suspension and removal of detritus.

Features of the arrangements described and shown in the Figures can be combined in any combination, as would be understood by the skilled reader as being practicable. The scope of the present disclosure is not intended to be limited to any particular described arrangement but instead is defined by the attached claims.

The invention claimed is:

1. A centralizer having a longitudinal axis, the centralizer comprising:

first and second opposing end collars positioned around the axis of the centralizer; and a plurality of spring bows extending from the first end collar via a generally convex curved portion to the second end collar;

wherein a radial distance from at least a portion of a protrusion of the first end collar to the axis is:

greater than a radial distance from a first outwardly facing portion of a spring bow of the plurality of spring bows to the axis at a longitudinal axial position where the spring bow extends from the first end collar; and less than a radial distance from a second outwardly facing portion of the spring bow to the axis at a longitudinal axial position between the first end collar and the second end collar that is farthest from the axis; and the centralizer is made from a single piece of material.

2. The centralizer according to claim 1, wherein the radial distance from the at least a portion of the protrusion of the first end collar to the axis is greater than the radial distance from a third outwardly facing portion of the spring bow to the axis at a longitudinal axial position where the spring bow extends from the second end collar.

3. The centralizer according to claim 1, wherein the protrusion is formed from the first end collar.

4. The centralizer according to claim 1, wherein the protrusion is in the form of a bow.

5. The centralizer according to claim 1, wherein the protrusion is formed through a process or processes involving one or more of a pressing process, a bending process, and a cutting process.

6. The centralizer according to claim 1, wherein the protrusion has a length and a width less than the length, wherein the length is angled to the longitudinal axis of the centralizer.

7. The centralizer according to claim 1, wherein the protrusion is a first protrusion of a plurality of protrusions and the plurality of protrusions are uniformly distributed about a perimeter of the first end collar.

8. The centralizer according to claim 1, wherein the outwardly facing portion of the first end collar has a shape configured to direct fluid flow into a turbulent flow.

9. A device having a longitudinal axis, the device configured to cooperate with a centralizer having a longitudinal axis, the centralizer comprising first and second opposing end collars positioned around the axis of the centralizer, and a plurality of spring bows extending from the first end collar via a generally convex curved portion to the second end collar, the device comprising:

a protrusion, wherein, when the axis of the device and the axis of the centralizer are substantially aligned coaxially, a radial distance from at least a portion of the protrusion of the device to the axis is:

greater than a radial distance from a first outwardly facing portion of a spring bow of the plurality of spring bows to the axis at a longitudinal axial position where the spring bow extends from the first end collar, and less than a radial distance from a second outwardly facing portion of the spring bow to the axis at a longitudinal axial position between the first end collar and the second end collar, and wherein the device is made from a single piece material.

10. The device according to claim 9, wherein the radial distance from the at least a portion of the protrusion of the device to the axis is greater than the radial distance from a third outwardly facing portion of the spring bow to the axis at a longitudinal axial position where the spring bow extends from the second end collar.

11. The device according to claim 9, wherein the protrusion is formed from the device.

12. The device according to claim 9, wherein the protrusion is in the form of a bow.

13. The device according to claim 9, wherein the protrusion has a length and a width less than the length, wherein the length is angled to the longitudinal axis of the device.

14. The device according to claim 9, wherein the protrusion is a first protrusion of a plurality of protrusions and the plurality of protrusions are uniformly distributed about a perimeter of the device.

15. The device according to claim 9, wherein the outwardly facing surface of the device has a shape configured to direct fluid flow into a turbulent flow.

16. The device according to claim 9, wherein the device has one or more connecting portions for connecting to a centralizer.

17. A system comprising:

a device having a longitudinal axis, the device configured to cooperate with a centralizer having a longitudinal axis, the centralizer comprising first and second opposing end collars positioned around the axis of the centralizer, and a plurality of spring bows extending from the first end collar via a generally convex curved portion to the second end collar, the device comprising:

a protrusion, wherein, when the axis of the device and the axis of the centralizer are substantially aligned co-axially, a radial distance from at least a portion of the protrusion of the device to the axis is:

greater than a radial distance from a first outwardly facing portion of a spring bow of the plurality of spring bows to the axis at a longitudinal axial position where the spring bow extends from the first end collar, and less than a radial distance from a second outwardly facing portion of the spring bow to the axis at a longitudinal axial position between the first end collar and the second end collar, and wherein the device is made from a single piece of material; and a centralizer having a longitudinal axis, the centralizer comprising first and second opposing end collars positioned around the axis of the centralizer, and a plurality of spring bows extending from the first end collar via a generally convex curved portion to the second end collar.

* * * * *